US011490180B2

(12) United States Patent
Coates et al.

(10) Patent No.: US 11,490,180 B2
(45) Date of Patent: Nov. 1, 2022

(54) ELECTROACOUSTIC DRIVER HOUSING ELEMENT

(71) Applicant: Eaton Intelligent Power Limited, Dublin (IE)

(72) Inventors: David Andrew Coates, Nottingham (GB); John Robbert Kendrick, Derby (GB)

(73) Assignee: EATON INTELLIGENT POWER LIMITED, Dublin (IE)

( * ) Notice: Subject to any disclaimer, the term of this patent is extended or adjusted under 35 U.S.C. 154(b) by 692 days.

(21) Appl. No.: 16/461,965

(22) PCT Filed: Nov. 15, 2017

(86) PCT No.: PCT/GB2017/053436
§ 371 (c)(1),
(2) Date: May 17, 2019

(87) PCT Pub. No.: WO2018/091887
PCT Pub. Date: May 24, 2018

(65) Prior Publication Data

US 2019/0327546 A1 Oct. 24, 2019

(30) Foreign Application Priority Data

Nov. 18, 2016 (GB) ..... 1619517

(51) Int. Cl.
*H04R 1/02* (2006.01)
*H04R 1/28* (2006.01)
(Continued)

(52) U.S. Cl.
CPC ..... *H04R 1/023* (2013.01); *H04R 1/2819* (2013.01); *H04R 1/30* (2013.01); *H04R 9/06* (2013.01); *H04R 2499/10* (2013.01)

(58) Field of Classification Search
CPC ..... H04R 1/023; H04R 1/2819; H04R 1/30; H04R 9/06; H04R 2499/10
See application file for complete search history.

(56) References Cited

U.S. PATENT DOCUMENTS 3,432,002 A 3/1969 Cohen
2009/0060246 A1 3/2009 Baliga et al.
(Continued)

FOREIGN PATENT DOCUMENTS

CN 202617202 U * 12/2012
CN 204013691 U * 12/2014
(Continued)

OTHER PUBLICATIONS

Junyangyuanyu, Sintered Wire Mesh with excellent mechanical properties for purification and filtration, Apr. 1, 2014, p. 1 (Year: 2014).*

(Continued)

*Primary Examiner* — Angelica M McKinney
(74) *Attorney, Agent, or Firm* — Stinson LLP

(57) ABSTRACT

The present invention provides for a woven mesh element for an electroacoustic driver enclosure, and to an electroacoustic driver enclosure including such an element, wherein the element includes a plurality of mesh layers, and wherein the plurality of layers includes a layer of Dutch weave mesh preferably including a layer of Dutch Twill weave mesh, and in particular wherein the element includes plural layers of cross woven wire mesh and a layer of Dutch weave wire mesh.

14 Claims, 3 Drawing Sheets

(51) Int. Cl.
*H04R 1/30* (2006.01)
*H04R 9/06* (2006.01)

(56) References Cited

U.S. PATENT DOCUMENTS

| | | | | |
|---|---|---|---|---|
| 2009/0245565 | A1 | 10/2009 | Mittleman et al. | |
| 2009/0274329 | A1* | 11/2009 | Ickler | G10K 11/26 381/338 |
| 2009/0288909 | A1* | 11/2009 | Slack | G10K 11/025 428/222 |
| 2014/0064542 | A1* | 3/2014 | Bright | H04R 1/086 381/359 |
| 2017/0041692 | A1* | 2/2017 | Watson | H04R 19/04 |

FOREIGN PATENT DOCUMENTS

| | | | | |
|---|---|---|---|---|
| DE | 3312318 | A1 * | 10/1984 | H04R 1/025 |
| DE | 3312318 | A1 | 10/1984 | |
| DE | 3312318 | A1 * | 11/1984 | H04R 1/00 |
| EP | 0582740 | A1 | 2/1994 | |
| EP | 0555951 | B1 * | 2/1996 | H04R 1/30 |
| GB | 2319105 | A * | 5/1998 | G08B 7/06 |
| KR | 100638512 | B1 * | 10/2006 | H04R 1/38 |
| KR | 100673843 | B1 * | 1/2007 | H04R 19/016 |
| WO | WO-2007043729 | A1 * | 4/2007 | H04R 1/38 |
| WO | 2009134591 | A1 | 11/2009 | |
| WO | 2010004285 | A1 | 1/2010 | |
| WO | WO-2010004285 | A1 * | 1/2010 | H04R 13/00 |
| WO | 2014035571 | A1 | 3/2014 | |

OTHER PUBLICATIONS

International Search Report for PCT/GB2017/053436, dated Jan. 17, 2018, 3 pages, Germany.

* cited by examiner

ELECTROACOUSTIC DRIVER HOUSING ELEMENT

CROSS-REFERENCE TO RELATED APPLICATIONS

This application is a National Stage Entry of, and claims priority to, PCT Patent Application No. PCT/GB2017/053436, filed Nov. 15, 2017, which claims priority to United Kingdom Patent Application No. 1619517.4, filed Nov. 18, 2016, both of which are hereby incorporated by reference in their entirety.

FIELD OF THE DISCLOSURE

The present invention relates to an electroacoustic driver housing element and in particular to a speaker or sounder comprising an enclosure employing such an element, and one that can be arranged for operation within a hazardous area.

BACKGROUND

Sound output devices such as speakers and sounders are commonly employed within, for example, industrial and/or processing environments comprising hazardous areas and environments. Such areas and environments include in particular those where there is the danger of explosion due for example to the possible presence of explosive gases, and in particular explosive dust. Explosive dust environments are particularly dangerous since dust explosions tend to be much more powerful than gas explosions for a given volume. For such areas classified as hazardous, it can prove essential that an electroacoustic driver unit is present so as to provide for audible sounds/signals such as for communication and/or alarm purposes.

The required use in such hazardous areas dictates that the electroacoustic driver unit is provided in a housing offering a sufficient degree of sealing so as to prevent any potentially explosive event occurring within the housing travelling to the hazardous area/environment within which the housing is located.

It is generally easier to prevent the ingress of dust into an enclosure than the ingress of gas and so the nature of protection is different for each. The protection concept for a gas atmosphere is to allow the gas into the enclosure but then prevent any internal explosion propagating to the outside atmosphere. The protection concept for an explosive dust atmosphere is to prevent any dust ingress into the enclosure since it is not currently possible to construct practical enclosures strong enough to contain dust explosions.

One form of speaker or sounder arranged for use within a hazardous area employs a sintered material to seal the housing and which, while allowing an audible signal to pass through, provides a sufficient degree of isolation to prevent any explosive event within the housing travelling into the hazardous area/environment.

However, various limitations and disadvantages are exhibited by such known arrangements. While allowing the required sound to be output into the area/environment, the sintered element nevertheless serves to attenuate the sound output from the driver thereby limiting the effective volume of its output. Also, such sintered elements commonly allow for water ingress and, if insufficiently dense, can also allow for dust ingress making such known driver units unsuitable for explosive dust-laden atmospheres.

Typically, a balance has to be struck between a requirement for a low density sinter for sound output and as against a minimum density requirement to effectively quench a flame arising from an explosive event within the housing and so as to prevent it propagating into the external explosive-atmosphere.

A further known complication is that for explosive dust environments, the density of the sinter element should be increased further so as to prevent the ingress of dust into the enclosure. As a consequence of this, loud speaker/sounder housings that are certified for use within explosive dust environments will typically offer a lower sound output for any given power rating.

It is known that particularly effective sintered elements for electroacoustic driver housings can comprise a layered structure employing several layers of an industry standard cross-woven metal mesh insofar as this is found to provide a good balance between flame quenching and porosity to sound, particularly insofar as the gas volume behind the sinter element is limited. Typically with such multi-layered standard cross-weave metal mesh sinter elements sound output is attenuated by −1 dB relative to the sinter being absent. While the level of attenuation is therefore attractive for such known woven metal mesh sinters, such structures are however not considered suitable for use in explosive dust environments and atmospheres, in particular since they are insufficiently dense to prevent ingress of dust.

SUMMARY OF THE DISCLOSURE

The present invention therefore seeks to provide an electroacoustic driver housing element arranged to allow for a sufficient level of sound output while offering the required degree of safety for operation in explosive environments and in particular those where explosive dust might be present.

It is a particular object of the present invention to provide an explosion-proof sounder/speaker having advantages over known such sounders/speakers and employing a sintered element that, while offering safe operation in explosive dust environments in particular, does not overly compromise the level of sound output from the sounder/speaker enclosure.

According to one aspect of the present invention, there is provided a woven mesh element for an electroacoustic driver enclosure, the element comprising a plurality of mesh layers, and wherein the said plurality includes a layer of Dutch weave mesh.

The present invention is advantageous insofar as it allows for an increase in sound output from electroacoustic drivers employed within hazardous environments and atmospheres, such as hazardous area horns and speakers, and which can be certified for use in hazardous dust environments but while providing improved sound attenuation figures as compared with the current art.

An advantage of the present invention is that it covers the aspects required by both gas and dust protection concepts, and so can provide a standard product that can meet both requirements with little compromise on sound output.

Through the provision of a multi-layer woven mesh element with one of the layers comprising a Dutch weave mesh, the present invention allows for the provision of a combination of wire mesh types, sintered together to form a flame arrester which can readily comply with the requirements of hazardous dust environment standards, without the elements porosity to sound being unduly compromised.

In one particularly advantageous configuration, the layer of Dutch weave mesh can comprise a layer of Dutch twill weave mesh.

Of course, it will be appreciated that the mesh layers best comprise woven wire mesh layers.

In one particular example, at least one of the plurality of mesh layers comprises a layer of cross woven mesh.

A particularly advantageous configuration of the present invention can comprise a multi-layered element comprising a plurality of layers of cross weave mesh and a single layer of Dutch weave mesh.

In one arrangement, the layer of Dutch weave mesh can be provided as an outer layer of the element, whereas in another example, the layer of Dutch weave mesh can comprise an inner layer of the said element.

Of course, it will be appreciated that the present invention can provide for a sintered metal element employing the structure as defined above and also an electroacoustic driver housing including an element such as defined above.

In particular, the housing can advantageously be arranged for providing use in flame-proof and/or explosion-proof characteristics.

Yet further, a loud speaker or sounder can be provided including such a housing as defined above.

As will therefore by appreciated, the present invention provides for an electroacoustic-driver-enclosure element comprising a plurality of mesh layers, and wherein the said plurality includes a layer of Dutch weave mesh. The provision of a single layer of, for example industry standard Dutch weave mesh, it is found to be effective at preventing the ingress of dust due, in particular, to the shape of the pores presented by the Dutch weave mesh.

With the combined use of different meshes that is at the heart of the present invention would advantageously provide a sintered element suitable for use in both explosive gas and explosive dust environments but without adversely affecting the level of attenuation of the sound produced by the electroacoustic driver. For example, it is found that the invention can, while being suitable for use in both explosive gas and explosive dust environments, attenuate the sound output only by −2 dB relative the sinter being absent.

It is noted that typical dust/certified sinters formed according to conventional methods typically attenuate sound by in the region of −6 dB.

It should also be appreciated that, while being focused in particular on explosive dust environments, the housing element of the present invention would be suitable for use in relation to all hazardous area gas groups. This has the particular advantage that a common driver/sounder/loudspeaker device can be provided meet both requirements.

BRIEF DESCRIPTION OF THE DRAWINGS

The invention is described further hereinafter, by way of example only, with reference to the accompanying drawings in which.

DETAILED DESCRIPTION

Figure 1:
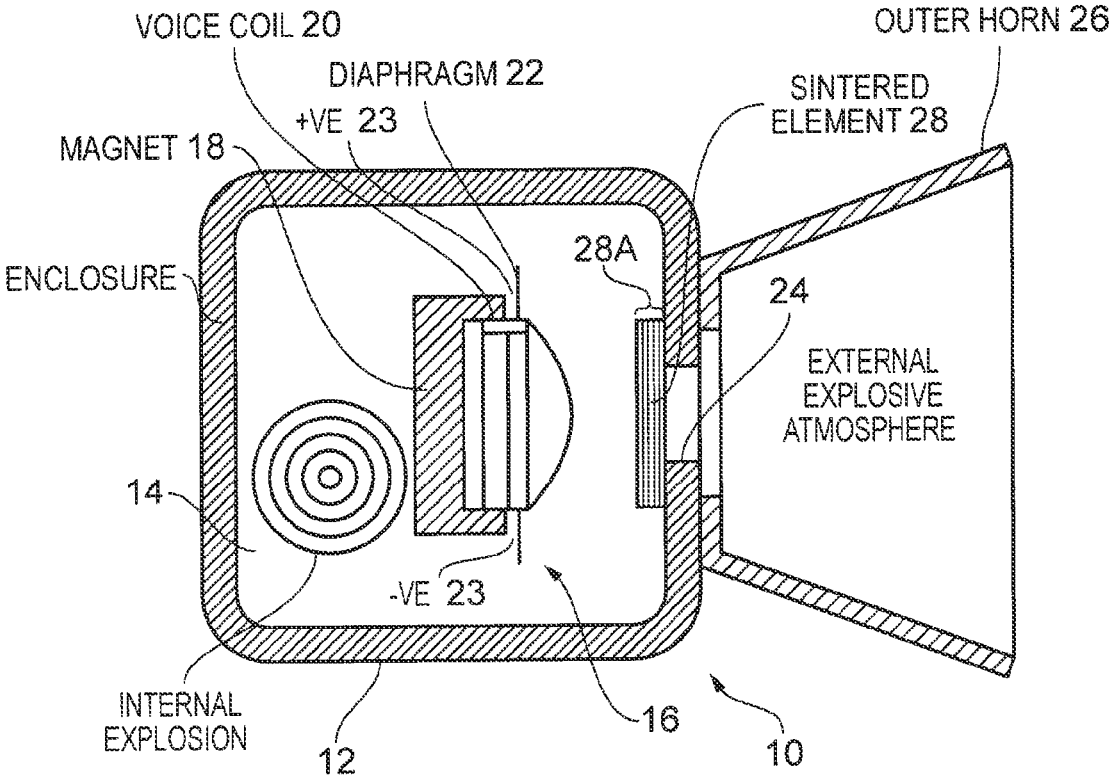
FIG. 1 is a schematic sectional view of an explosion-proof loudspeaker according to an embodiment of the present invention.

Turning first to FIG. 1, there is illustrated a sounder/speaker assembly 10 comprising a housing 12 enclosing an internal volume 14 in which there is located an electroacoustic driver 16 comprising a relatively large permanent magnetic 18, a voice coil 20 mounted to a diaphragm 22. The driver and diaphragm are arranged to supply, in response to an audio signal at the positive/negative terminals 23, audible sound waves arranged to exit the housing 12 by way of an opening 24. Beyond the opening 24 on the outside of the housing 12 is a frusto-conical outer horn 26 serving to acoustically couple the output audible signal.

In order to provide sufficient sealing of the housing 12, so as to effectively isolate it from the external environment and so prevent any internal explosion event within the internal volume 14 from travelling to the external environment, a flat disk-like sintered metal element 28 is provided and serving to close the opening 24 and offer the required isolation between the enclosure internal volume 14 and the hazardous environment external to the housing 12. In particular, the sintered metal element 28 is provided to quench a flame of an internal explosion and comprises a metal mesh sinter.

The sound waves created by the driver 16 can however pass through this sintered element 28 and onward via the outer horn 26 although a degree of attenuation occurs at the sintered element 28. Such attenuation can, to some extent, be compensated for by an overly large and expensive driver 16 and associated magnet 18.

Within the illustrated example of FIG. 1, the sintered element 28 comprises a plurality of layers of wire mesh 28A sintered together so as to form the sintered element 28 and, as required by the present invention, employing as one of the layers, a layer of Dutch weave mesh.

Further details of the sintered element 28 of the present invention according to the embodiment of FIG. 1 are illustrated with reference to FIGS. 2 and 3.

Figure 2:
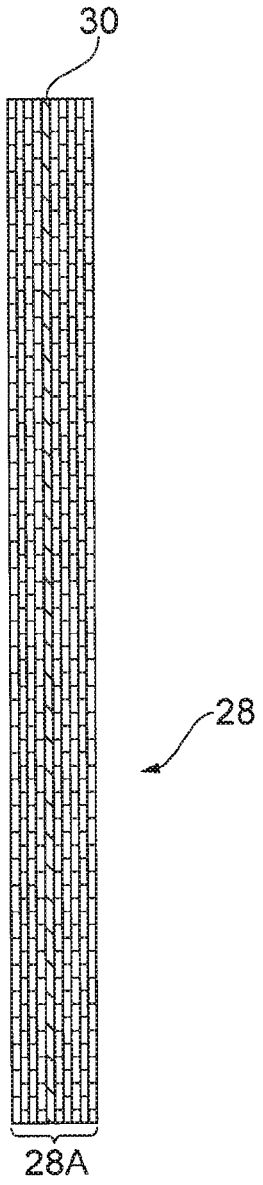
FIG. 2 is a schematic sectional view of one example of a sintered housing element such as employed in the loudspeaker of FIG. 1, and according to an embodiment of the present invention.
Figure 3:
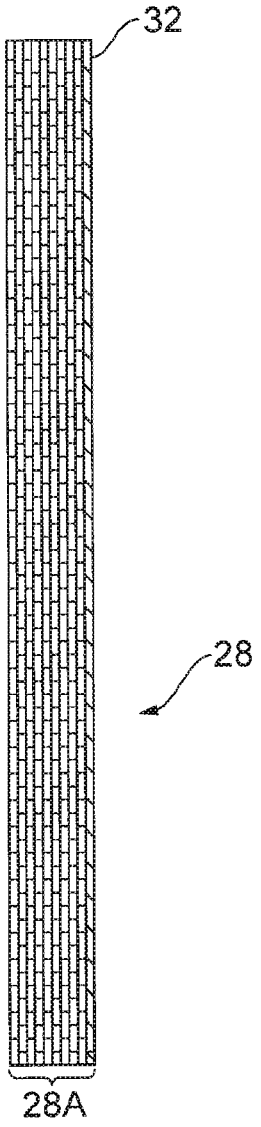
FIG. 3 is a schematic sectional view of another example of a sintered housing element such as employed in the loudspeaker of FIG. 1, and according to another embodiment of the present invention

Turning therefore to FIG. 2, there is provided a sectional view of the sintered element 28 employed within the housing 12 of FIG. 1 and which, as noted, comprises a plurality of wire mesh layers 28A sintered together.

Although in no way limited to the present invention, within the illustrated embodiment the multi-layered sintered element 28 includes a single layer 30 of Dutch weave mesh which in the illustrated example comprises a single layer of industry standard Dutch twill weave 30×250 uM mesh, 0.0075' wire diameter, which can also be referred to as micromesh. The remaining (9 in the illustrated example) layers are each formed of industry standard cross weave wire mesh, which in the illustrated example can comprise 60×60 uM mesh, 0.0075' wire diameter.

As illustrated with reference to FIG. 2, in this particular example, the layer of Dutch twill weave mesh is provided within the body, and generally within a central region, of the multi-layered sintered element 28.

However, other locations for the layer of Dutch twill weave mesh are available such as illustrated with reference to FIG. 3.

Here, it can be seen that the single layer 32 of Dutch twill weave mesh is provided on, and forming part of, an outer surface of the sintered element 28.

As will be appreciated from reference to the illustrated examples of the present invention in particular, the element of the present invention proves advantageous insofar as it can prevent the ingress of dust due to the presence of the layer of Dutch twill weave mesh thereby meeting the required standards for explosive dust hazardous areas. However, insofar as the remainder of the sinter element is provided by layers of industry standard cross weave wire mesh the overall porosity to sound of the sintered element 28 is limited only to a minor, and readily acceptable, degree.

The overall layered structure therefore acts an effective flame arrester for explosive gas atmospheres, while being sufficiently porous to sound, but with the added feature of preventing the ingress of dust as noted above.

The combination of mesh types as employed within the present invention therefore provides for a sintered element offering sufficient porosity to sound along with effective flame arrester capabilities and while preventing the ingress of dust when located in explosive dust environments.

It should be appreciated that the embodiments illustrated with reference to the accompanying Figures are only some of the possible examples of the present invention and which is therefore not limited to the details of the illustrated embodiments. For example, the sintered element can be formed of any required number of layers of mesh material which could comprise two or more different types of mesh. Also, if required, more than one layer of Dutch twill woven mesh could be provided within the sintered element 28 and the overall shape and configuration of the sintered element is in no way restricted to that as illustrated in the accompanying drawings.

Also, reference to a loudspeaker and sounder are intended to encompass an electroacoustic transducer-based device for outputting any form of audible sound wave or signal.

The invention claimed is:

1. A woven mesh element for an enclosure for an electroacoustic driver, the woven mesh element comprising:

a plurality of mesh layers sintered together, wherein said plurality of mesh layers includes a layer of Dutch weave mesh, and wherein the plurality of mesh layers includes a plurality of wire mesh layers and only a single layer of Dutch weave mesh.

2. The woven mesh element as claimed in claim 1, wherein said layer of Dutch weave mesh comprises a layer of Dutch Twill weave mesh.

3. The woven mesh element as claimed in claim 1, wherein said plurality of mesh layers comprises woven wire mesh layers.

4. The woven mesh element as claimed in claim 1, wherein the Dutch weave mesh comprises a metal mesh.

5. The woven mesh element as claimed in claim 1, wherein the plurality of mesh layers includes a layer of cross woven mesh.

6. The woven mesh element as claimed in claim 5, wherein the plurality of mesh layers includes a plurality of layers of cross weave mesh.

7. The woven mesh element as claimed in claim 6, wherein the plurality of mesh layers includes a single layer of Dutch weave mesh.

8. The woven mesh element as claimed in claim 1, wherein the layer of Dutch weave comprises an outer layer of the woven mesh element.

9. The woven mesh element as claimed in claim 1, wherein the layer of Dutch weave comprises an inner layer of the woven mesh element.

10. The woven mesh element as claimed in claim 1, further comprising a flame arrester.

11. The enclosure for the electroacoustic driver, wherein the enclosure includes the woven mesh element as claimed in claim 1.

12. The enclosure as claimed in claim 11, wherein the enclosure is flame-proof and/or explosion-proof.

13. A loudspeaker or sounder including the enclosure as claimed in claim 11.

14. An element of an enclosure of an electroacoustic driver comprising:

a plurality of mesh layers sintered together, wherein said plurality of mesh layers includes a layer of Dutch weave mesh, and wherein the plurality of mesh layers includes a plurality of wire mesh layers and only a single layer of Dutch weave mesh.

* * * * *